US007883371B1

(12) United States Patent
Chen et al.

(10) Patent No.: US 7,883,371 B1
(45) Date of Patent: Feb. 8, 2011

(54) ELECTRICAL CONNECTOR WITH IMPROVED CONTACT FOOTPRINTS

(75) Inventors: Kuan-Yu Chen, Harrisburg, PA (US); Terrance F. Little, York, PA (US); Jia-Yong He, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 13 days.

(21) Appl. No.: 12/460,707

(22) Filed: Jul. 22, 2009

(51) Int. Cl.
*H01R 13/648* (2006.01)

(52) U.S. Cl. ..... 439/607.41; 439/577; 385/88

(58) Field of Classification Search ..... 439/607.41, 439/607.5, 577; 385/75, 88
See application file for complete search history.

(56) References Cited

U.S. PATENT DOCUMENTS 5,725,386 A 3/1998 Davis et al.
5,769,666 A 6/1998 Wu
7,481,677 B1 1/2009 Yi

FOREIGN PATENT DOCUMENTS

CN 101345358 A 1/2009

*Primary Examiner*—Truc T Nguyen
(74) *Attorney, Agent, or Firm*—Wei Te Chung; Andrew C. Cheng; Ming Chieh Chang

(57) ABSTRACT

An electrical connector includes a housing member and a number of contacts attached to the housing member. The contacts include a number of first contacts and second contacts arranged side by side along a transverse direction, respectively. The second contacts include a first pair of differential contacts, a second pair of differential contacts and a grounding contact disposed therebetween. At the mounting end of the electrical connector, a space between the grounding contact and the differential contact of each pair most adjacent to the grounding contact is much bigger than any internal space between the differential contacts of each the first or the second pair. As a result, a rear wall of the housing member can provide adequate area for easily mounting a fiber optical lens.

20 Claims, 16 Drawing Sheets

ELECTRICAL CONNECTOR WITH IMPROVED CONTACT FOOTPRINTS

BACKGROUND OF THE INVENTION

1. Field of the Invention

The present invention relates to electrical connectors, more particularly to electrical connectors with improved contact footprints for easily receiving a fiber optical lens.

2. Description of Related Art

U.S. Pat. No. 5,769,666 discloses an electrical connector including an insulative housing, a plurality of contacts retained in the housing and a metal shield received in the housing. The contacts include contact portions and bending portions extending downwardly from rear ends of the contact portions. The bending portions are perpendicular to the contact portions and include contractive tail portions for being soldered to a PCB. The metal shield encloses the contact portions for EMI protection. The bending portions directly extend downwardly from the rear ends of the contact portions. The bending portions occupy much area of a rear wall of the housing because a width of the bending portion viewed from a rear-to-front direction is much larger than that viewed from left-to-right direction. As a result, the rear wall of the housing doesn't have reasonable area for mounting components from the rear-to-front direction.

Hence, an improved electrical connector is desired to overcome the above problems.

BRIEF SUMMARY OF THE INVENTION

An electrical connector having a mating end for receiving a complementary connector and a mounting end for being mounted to a circuit board, includes a housing member and a plurality of contacts attached to the housing member. The contacts comprise a plurality of first contacts having first contact portions and first tail portions, and a plurality of second contacts having second contact portions, second bending portions substantially perpendicular to the second contact portions and second tail portions formed at distal ends of the second bending portions. The first and the second contact portions are disposed at the mating end and the first and the second tail portions are disposed at the mounting end. The first and the second contact portions are located at a same side of the housing member under a condition that the first contact portions are arranged side by side along a transverse direction, and similarly, the second contact portions are arranged side by side along the transverse direction. The second contacts comprise a first pair of differential contacts, a second pair of differential contacts and a grounding contact disposed therebetween. The first and the second tail portions are arranged in two parallel transverse rows. Each of the second bending portion comprises a first width viewed from a left-to-right direction along the transverse direction, and a second width viewed from a rear-to-front direction along a longitudinal direction in condition that the second width is narrower than the first width. At the mounting end, a space between the grounding contact and the differential contact of each pair most adjacent to the grounding contact is much bigger than any internal space between the differential contacts of each the first or the second pair. As a result, a relative wider space can be provided between the first and the second pairs of differential contacts for easily mounting a fiber optical lens.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 3 is a rear elevational view of the electrical connector shown in

FIG. 2;

DETAILED DESCRIPTION OF THE PREFERRED EMBODIMENTS

Figure 1:
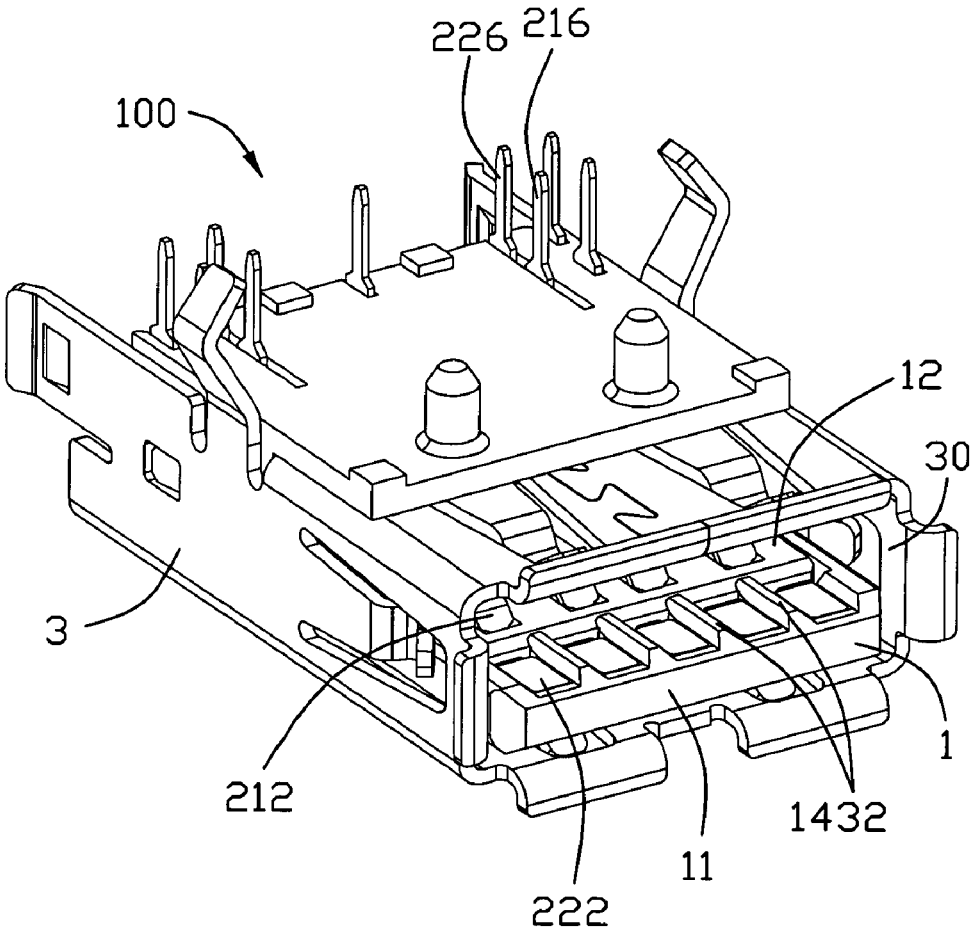
FIG. 1 is a perspective view of an electrical connector according to a first preferred embodiment of the present invention.
Figure 2:
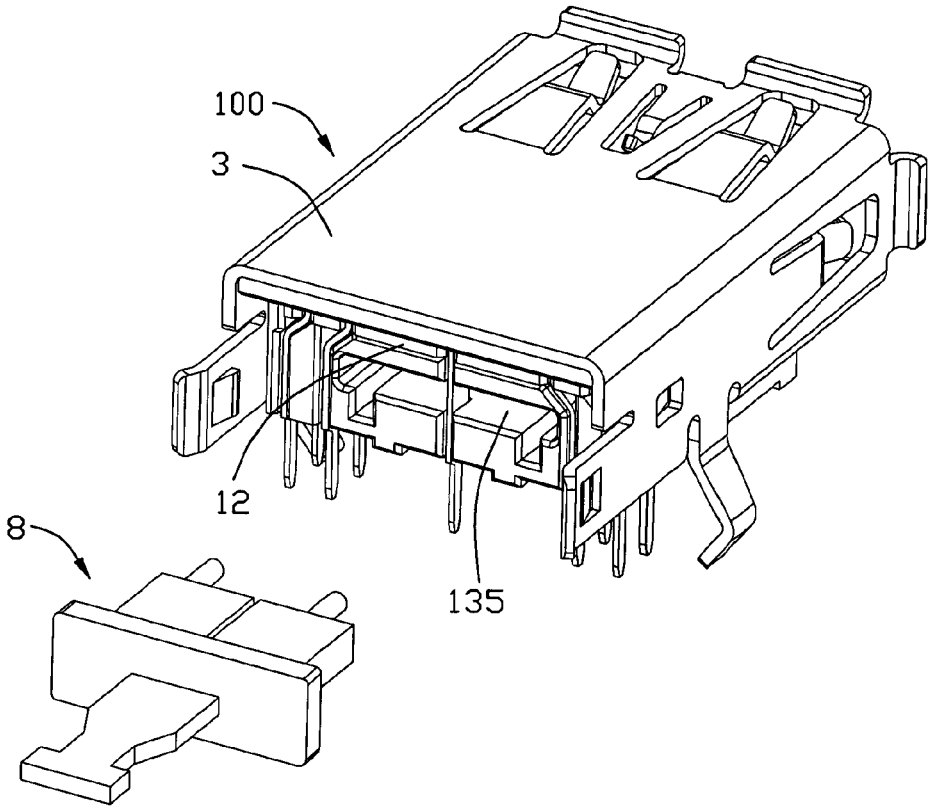
FIG. 2 is a perspective view of the electrical connector shown in FIG. 1, while taken from another aspect before insertion of a fiber optical lens.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-5, an electrical connector 100 defines a mating end for receiving a complementary connector (not shown) and a mounting end for being mounted on a printed circuit board (PCB, not shown). The electrical connector 100 is an optical/electrical connector and includes a housing member 1, a plurality of contacts 2 attached to the housing member 1 and a metal shield 3 enclosing the housing member 1. The housing member 1 includes a first insulative housing 11 and a second insulative housing 12 received in the first insulative housing 11. The separate first and second insulative housings 11, 12 can facilitate assembly of the contacts 2, which will be detailed hereinafter.

Figure 6:
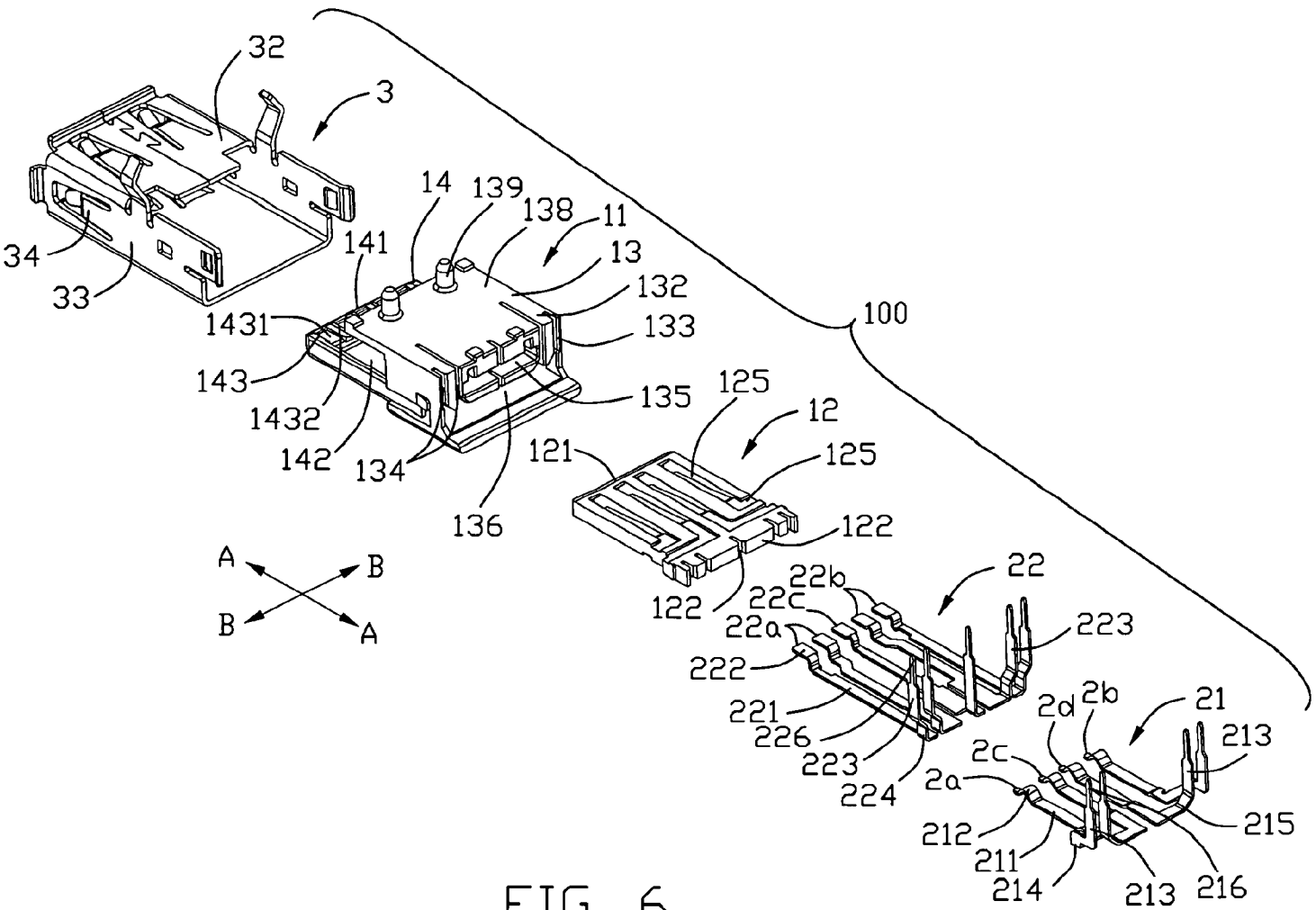
FIG. 6 is an exploded perspective view of the electrical connector shown in FIG. 1.
Figure 7:
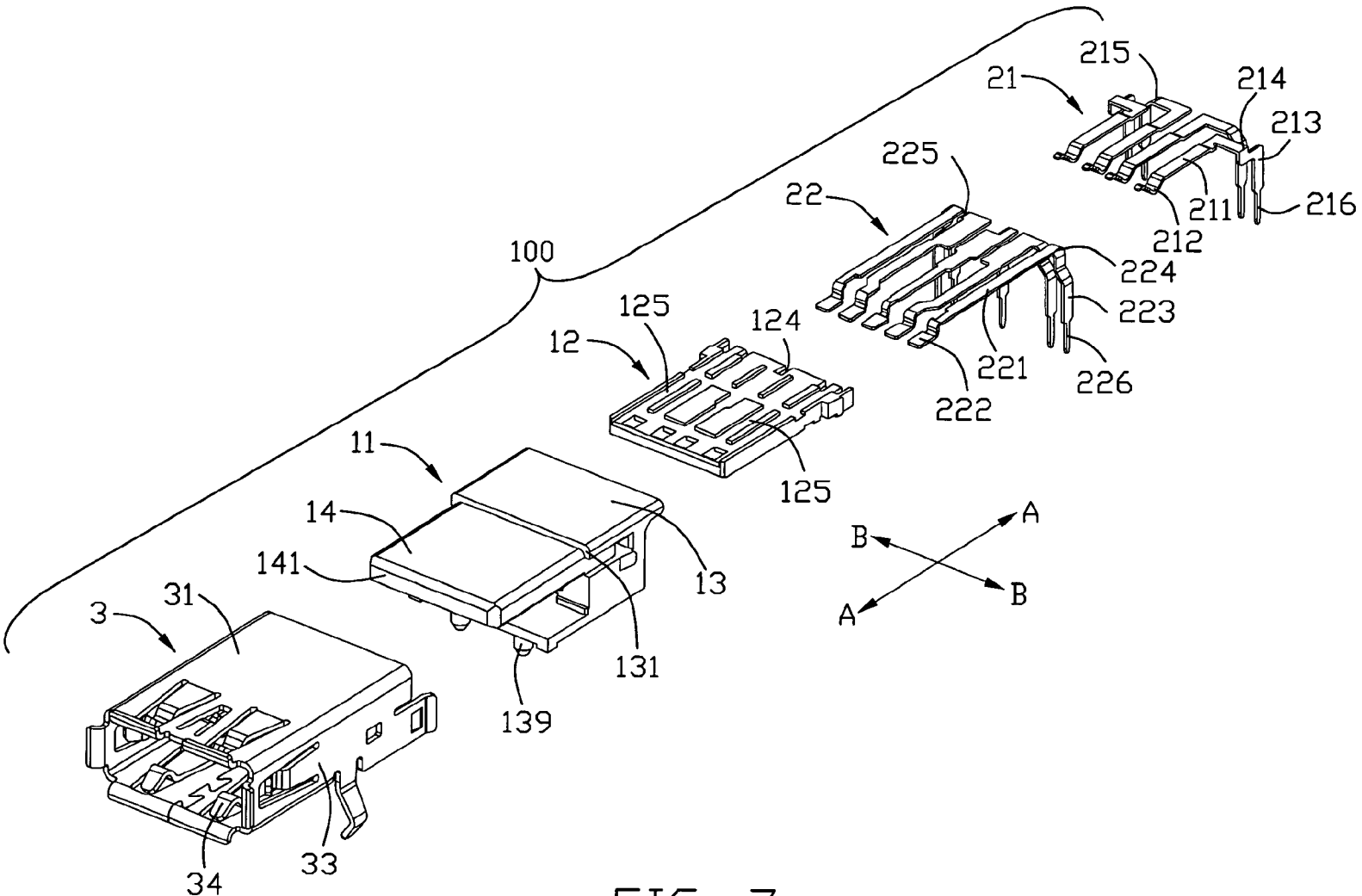
FIG. 7 is another exploded perspective view of the electrical connector shown in FIG. 6, but taken from another aspect.

Referring to FIGS. 6 and 7, the first insulative housing 11 includes a base portion 13 and a tongue plate 14 extending forwardly from a front face 131 of the base portion 13. The tongue plate 14 extends along a longitudinal direction A-A as shown in FIG. 6. The base portion 13 includes a bottom mounting wall 138 and a rear side 132 opposite to the front face 131. A pair of mounting posts 139 are provided extending downwardly from the mounting walls 138 for being received in corresponding through holes (not shown) defined in the PCB so that the electrical connector 100 can be firmly mounted on the PCB. The rear side 132 of the base 13 includes a rear face 133 with five parallel first slits 134 recessed therefrom. Each first slit 134 extends along the longitudinal direction A-A, while all the first slits 134 are arranged side by side along a transverse direction B-B which is perpendicular to the longitudinal direction A-A, as best shown in FIG. 6. The rear side 132 of the base portion 13 further includes a through hole 135 extending through the rear face 133 along the longitudinal direction A-A under a condition that the through hole 135 is adapted for receiving a fiber optical lens 8 (shown in FIG. 2) in order to enhance high speed signal transmission of the electrical connector 100. In assembly, the fiber optical lens 8 is optically connected to a precision block on the PCB (the PCB and the precision block not shown) for mating with another fiber optic of the complementary connector which is mateable with the electrical connector 100. The base 13 includes a rectangular shaped receiving cavity 136 throughout the front and the rear faces 131, 133 for receiving the second insulative housing 12.

The tongue plate 14 includes a free end 141 opposite to the base portion 13, a receiving opening 142 communicating with the receiving cavity 136, and a receiving base 143 located between the free end 141 and the receiving opening 142 along the longitudinal direction A-A. The receiving base 143 defines a plurality of parallel rectangular depressions 1431 communicating with the receiving opening 142, and then forms a plurality of projections 1432 separating the adjacent two depressions 1431. Each depression 1431 extends along the longitudinal direction A-A as well.

The second insulative housing 12 includes opposite first and second ends 121, 122, and a plurality of second slits 124 recessed from the second end 122. The second insulative housing 12 further defines a plurality of passageways 125 on opposite upper and lower sides thereof for mounting the contacts 2.

As shown in FIGS. 6-10, the contacts 2 include a plurality of first contacts 21 and a plurality of second contacts 22. The first contacts 2 include a power contact 2*a*, a ground contact 2*b*, a first signal contact 2*c* and a second signal contact 2*d* disposed side by side along the transverse direction B-B. The second contacts 22 include a first pair of differential contacts 22*a*, a second pair of differential contacts 22*b* and a grounding contact 22*c* located between the first and the second pairs of differential contacts 22*a*, 22*b*. Each first contact 21 includes an L-shaped first main portion 211, an elastic first contact portion 212 at one end of the first main portion 211, and a first bending portion 213 extending downwardly from the other end of the first main portion 211. The first main portion 211 has a certain width thereof and located in a horizontal plane. The other end of the first main portion 211 includes opposite lateral edges 214, 215 in the horizontal plane. The first bending portion 213 bends downwardly from one of the lateral edges 214, 215 and substantially perpendicular to the first main portion 211. The first bending portion 213 further includes a contractive first soldering portion 216 at a distal end thereof and extending downwardly to be soldered to the PCB.

Each second contact 22 includes a second main portion 221, a stiff second contact portion 222 at one end of the second main portion 221, and a second bending portion 223 extending downwardly from the other end of the second main portion 221. The second main portion 221 is located in a horizontal plane. The other end of the second main portion 221 includes opposite lateral edges 224, 225 in the horizontal plane. The second bending portion 223 bends downwardly from one of the lateral edges 224, 225 and substantially perpendicular to the second main portion 221. The second bending portion 223 further includes a contractive second soldering portion 226 at a distal end thereof and extending downwardly to be soldered to the PCB.

Figure 4:
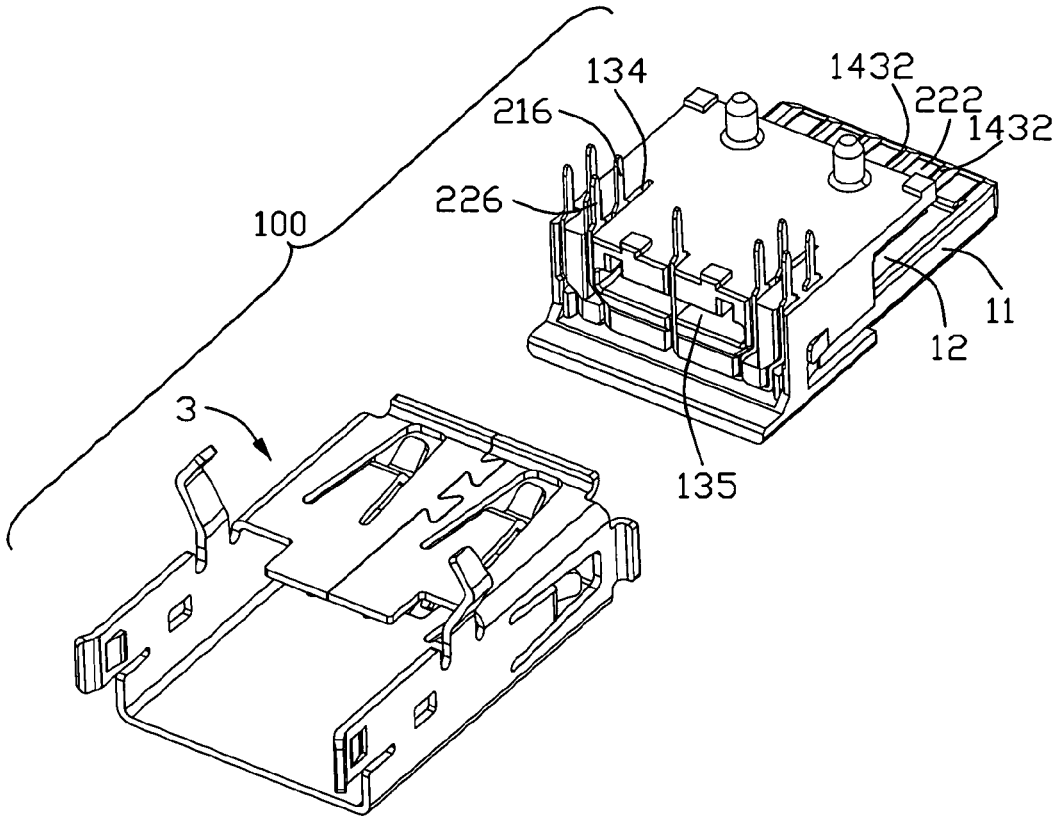
FIG. 4 is a part exploded perspective view of the electrical connector showing a metal shield disengaging from a housing member.
Figure 5:
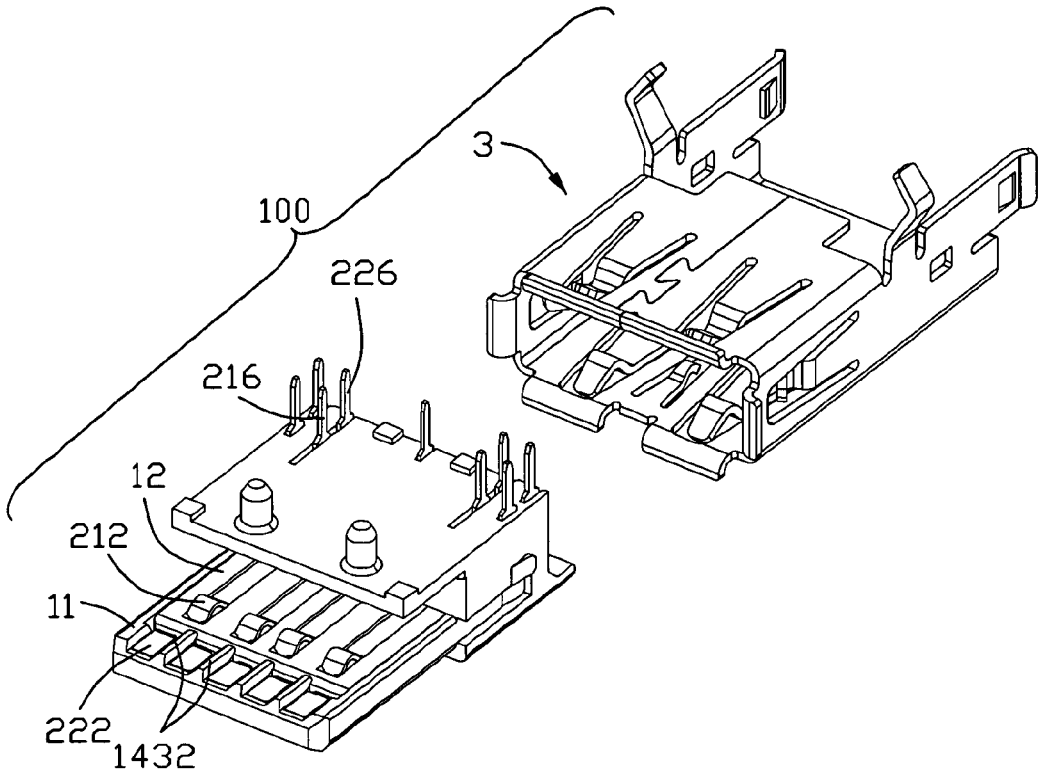
FIG. 5 is another part exploded perspective view of the electrical connector similar to FIG. 4, while taken from another aspect.
Figure 8:
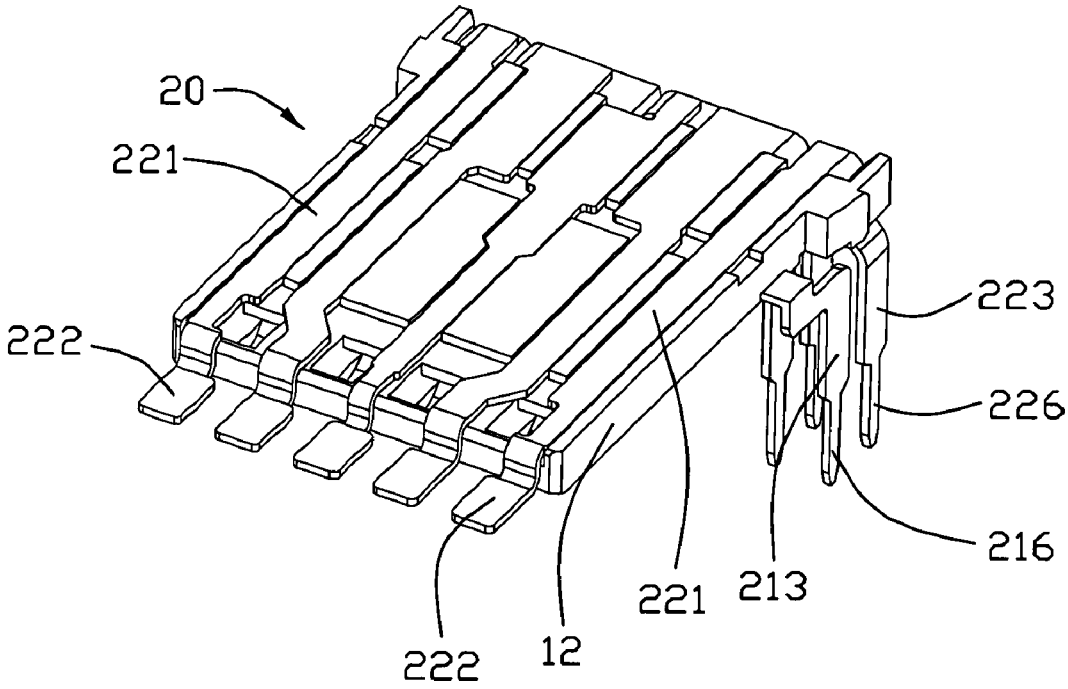
FIG. 8 is a perspective view of a contact module.
Figure 9:
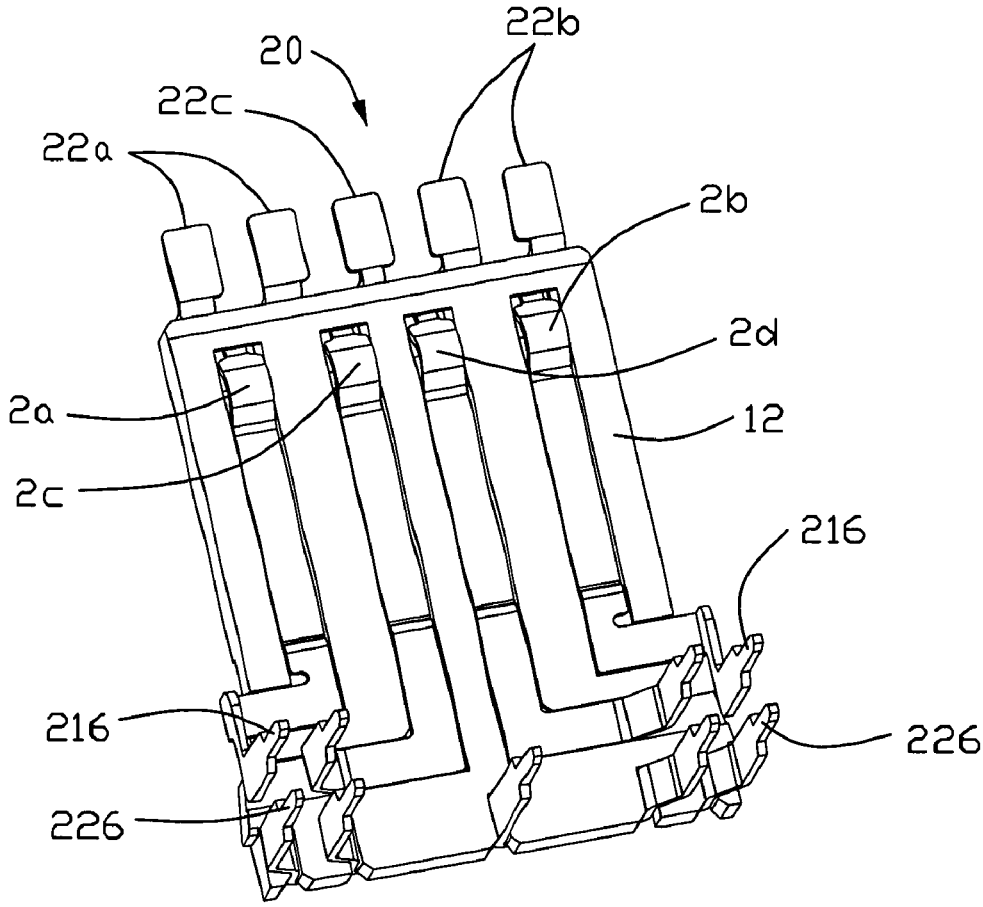
FIG. 9 is another perspective view of FIG. 8, while taken from another aspect.

Referring to FIGS. 4, 5 and 8, in assembly, the first and the second contacts 21, 22 are attached to the second insulative housing 12 from upper and lower sides thereof to form a contact module 20. The first and the second main portions 211, 221 are retained in the corresponding passageways 125 of the second insulative housing 12, and the second bending portions 223 extend through the second slits 124 for preliminary positioning. As shown in FIG. 9, the second contact portions 222 further cantileveredly extend beyond the first end 121 of the second insulative housing 12. The first contacts 21 are arranged in an area between the second contact portions 222 and the second soldering portions 226 along the longitudinal direction A-A. Then, the contact module 20 is jointly received in the receiving cavity 136 and the receiving opening 142 from a rear-to-front direction along the longitudinal direction A-A. The second contact portions 222 are received in the corresponding depressions 1431 of the tongue plate 14. At the mating end of the electrical connector 100, the first and the second contact portions 212, 222 are located at the same side of the housing member 1 while offset from each other along the longitudinal direction A-A. The first contact portion 212 downwardly extends beyond the second insulative housing 12. All the first and the second bending portions 213, 223 are received in the first slits 134 of the base portion 13. The first and the second bending portions 213, 223 which are received in the same first slit 134 aligned with each other along the longitudinal direction A-A. The first and the second soldering portions 216, 226 are disposed at the mounting end of the electrical connector 100 for being soldered to the PCB. The first and the second soldering portions 216, 226 are arranged in two parallel rows parallel to the transverse direction B-B.

Figure 3:
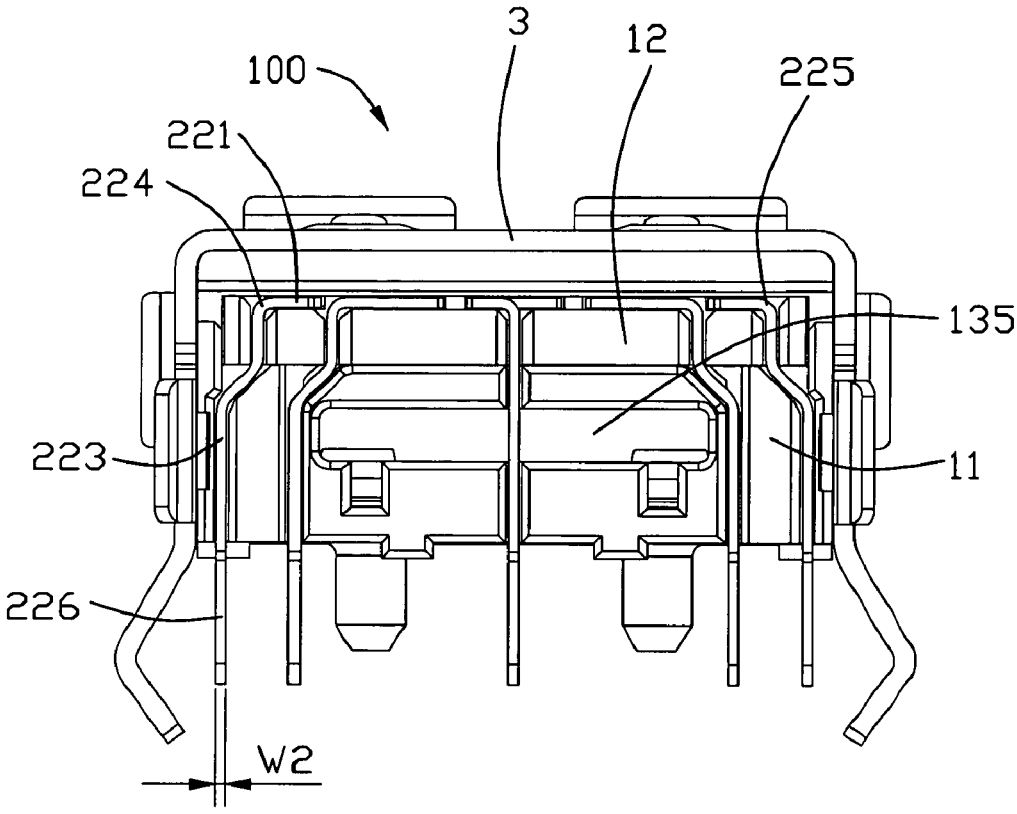
Figure 10:
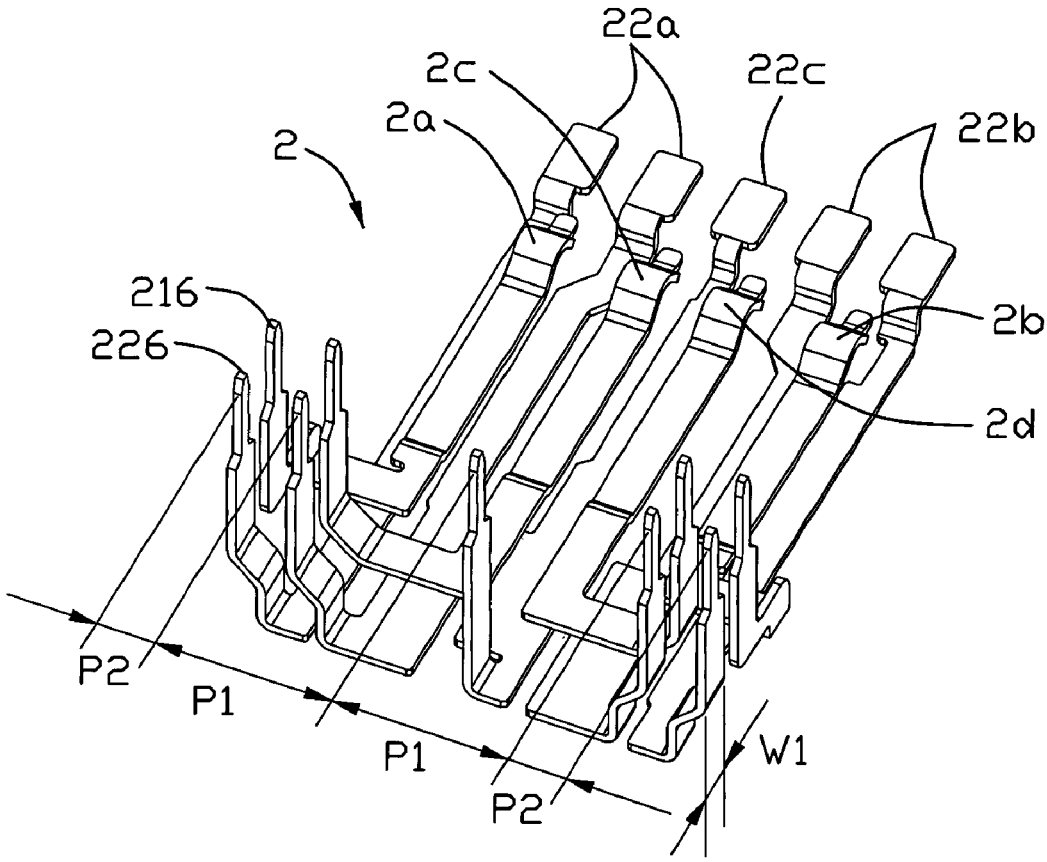
FIG. 10 is a perspective view of the contacts shown in FIG. 9.

As shown in FIGS. 3 and 10, each first or second bending portion 213, 223 has a first width W1 viewed from a left-to-right direction parallel to the transverse direction B-B, and a second width W2 viewed from the rear-to-front direction parallel to the longitudinal direction A-A, wherein the second width W2 is much narrower than the first width W1. As a result, the first and the second bending portions 213, 223 occupy a small space of the rear side 132 of the first insulative housing 11 and left adequate space between the middle adjacent two second bending portions 223 for insertion of the fiber optical lens 8. Besides, at the mounting end of the electrical connector 100 as shown in FIG. 10, a space P1 between the grounding contact 22*c* and the differential contact of each pair most adjacent to the grounding contact 22*c* is much bigger than any internal space P2 between the differential contacts of each pair. As a result, the fiber optical lens 8 can be easily inserted into the electrical connector 100 through the space P1 along the rear-to-front direction. The first and the second bending portions 213, 223 extend from a lateral edge of the corresponding first and the second main portions 211, 221. The first and the second soldering portions 216, 226 are parallel to each other and extend beyond the first and the second slits 134, 124 for being soldered to the PCB. The first and the second main portions 211, 221 are located in the horizontal planes, and the first and the second bending portions 213, 223 are located in the vertical planes.

As shown in FIGS. 9 and 10, at the mounting end of the electrical connector 100, all the first soldering portions 216 are arranged in a single row along the transverse direction B-B and all the second soldering portions 226 are arranged in another single row parallel to the single row. The first soldering portions 216 of the power contact 2*a* and the first signal contact 2*c* are respectively aligned with the second soldering portions 226 of the first pair of differential contacts 22*a* along the longitudinal direction A-A. Similarly, the first soldering portions 216 of the second signal contact 2*d* and the ground contact 2*b* are respectively aligned with the second soldering portions 226 of the second pair of differential contacts 22*b* along the longitudinal direction A-A.

Referring to FIGS. 6 and 7, the metal shield 3 is in a tube shape, which defines a top face 31, a bottom face 32 opposite to the top face 31 and a pair of sidewalls 33 connecting the top face 31 and the bottom face 32. The metal shield 3 is secured to the base portion 13 of the first insulative housing 11 to enclose the tongue plate 14 and the second insulative housing 12. The metal shield 3 encloses the housing member 1 to form a receiving space 30 to which the first and the second contact portions 212, 222 are exposed. Each of the top and bottom faces 31, 32 and the pair of sidewalls 33 include at least one spring arm 34 projecting into the receiving space 30 for abutting against the corresponding connector for retaining and grounding purposes.

Figure 11:
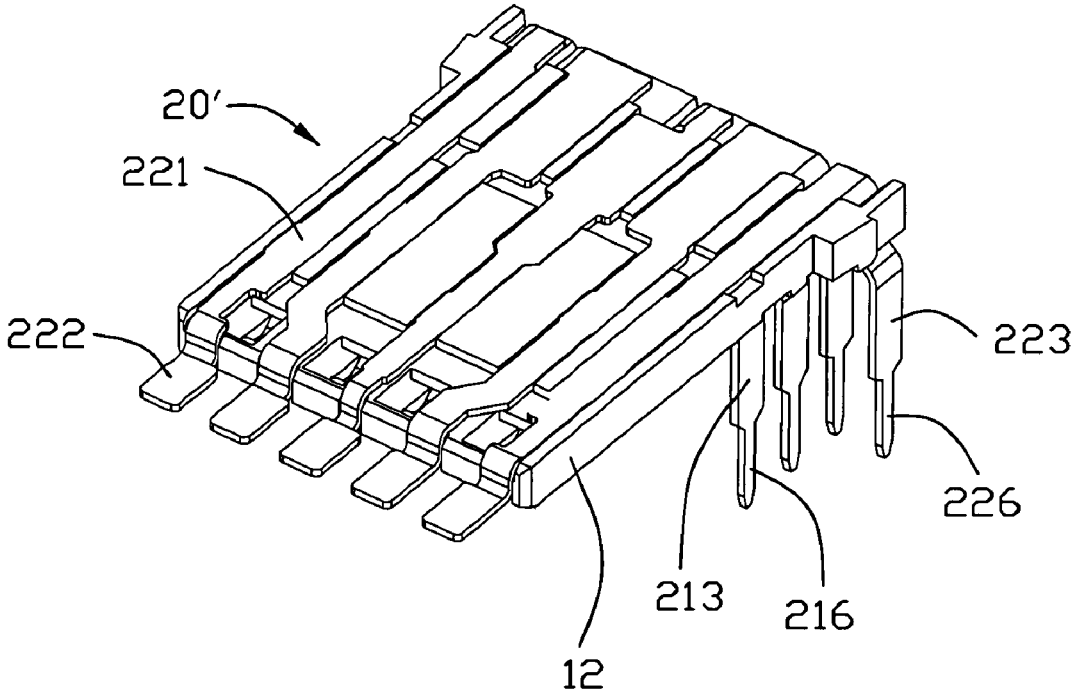
FIG. 11 is a perspective view of another contact module according to a second preferred embodiment of the present invention.
Figure 12:
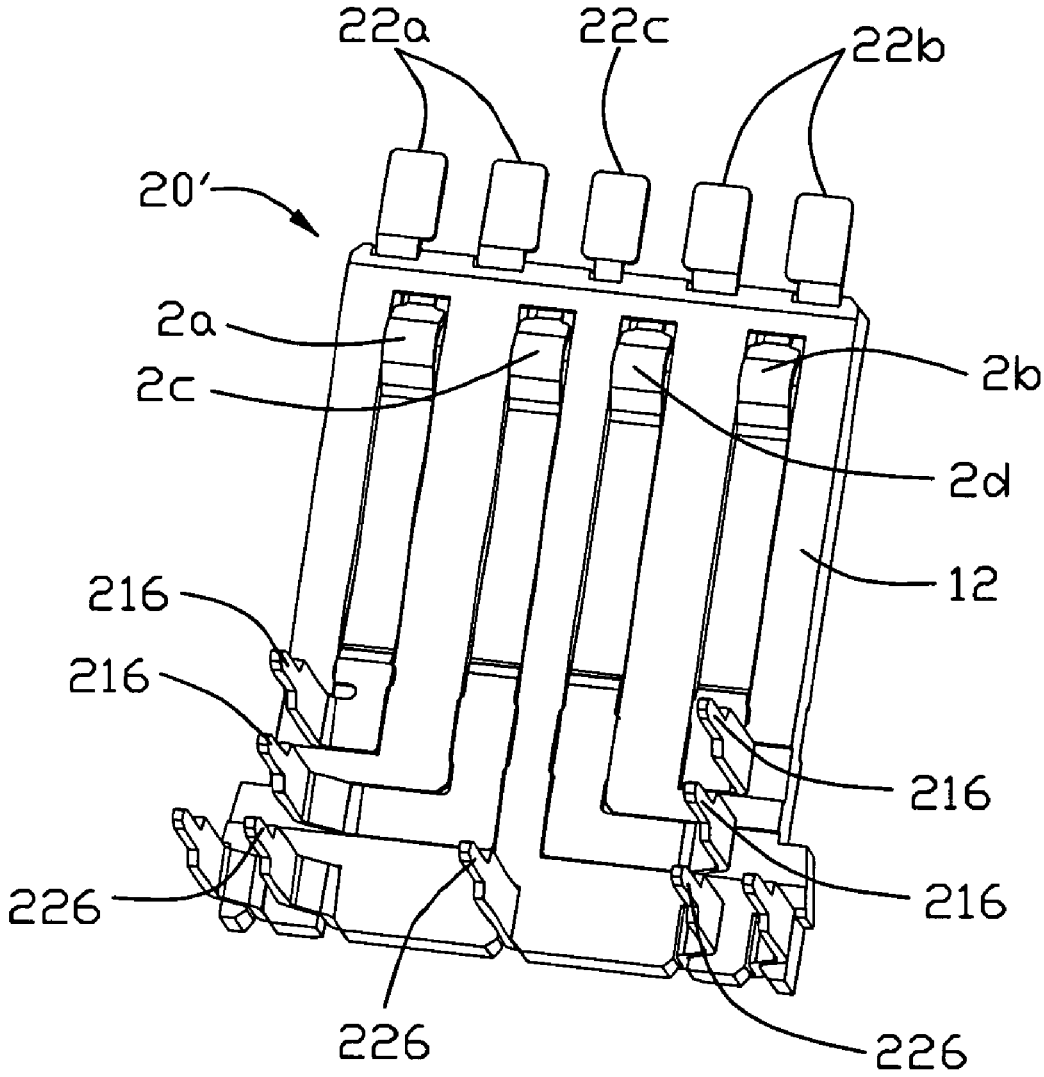
FIG. 12 is another perspective view of FIG. 11, while taken from another aspect.
Figure 13:
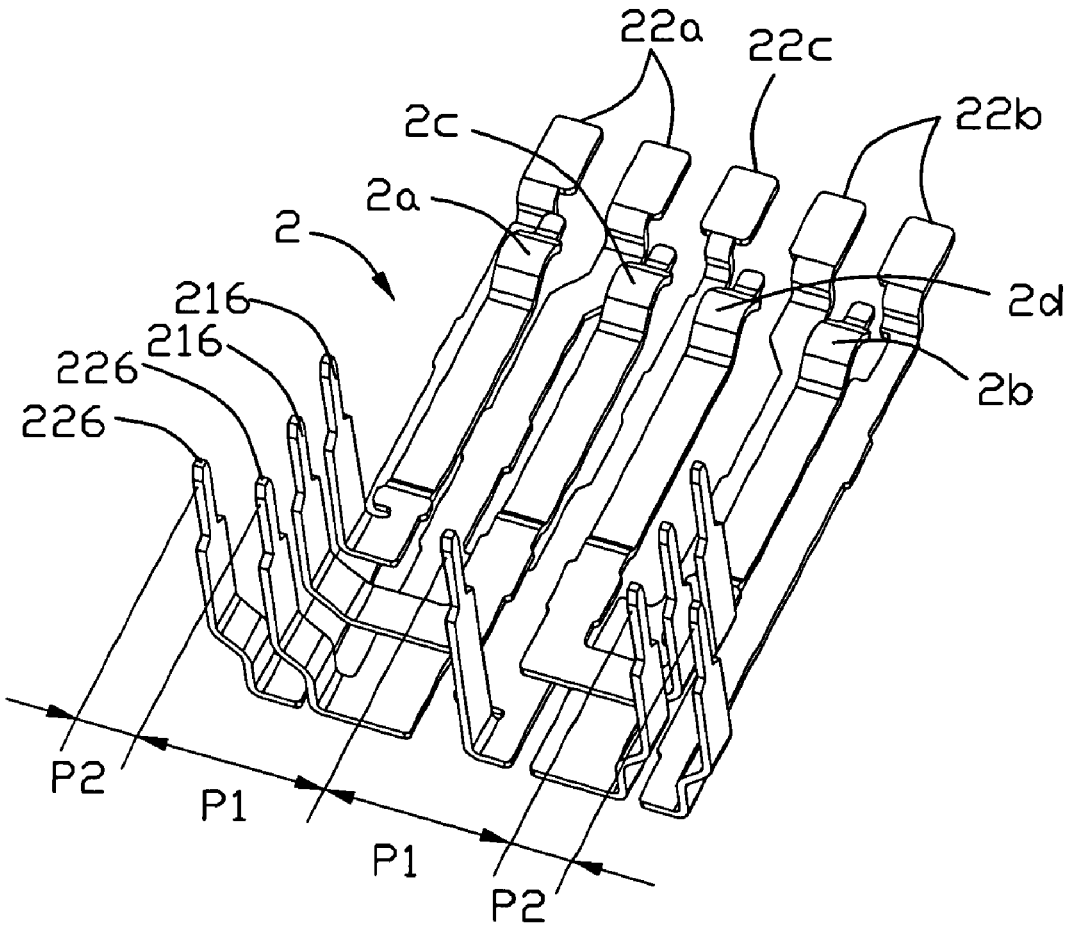
FIG. 13 is a perspective view of the contacts shown in FIG. 12.

Referring to FIGS. 11 to 13, according to a second embodiment of the present invention, the contact module 20' is similar to the contact module 20 of the first embodiment. The differences between them are the contact footprints. In detail, at the mounting end, all the first soldering portions 216 of the first contacts 21 are arranged in two parallel transverse rows, among which the first soldering portions 216 of the power contact 2*a* and the first signal contact 2*c* are arranged in a first row and the first soldering portions 216 of the second signal contact 2*d* and the ground contact 2*b* are arranged in a second row parallel to the first row. All the second soldering portions 226 of the second contacts 22 are arranged in another single row parallel to the first and the second rows. The first soldering portions 216 of the power contact 2*a* and the first signal contact 2*c* are aligned with the second soldering portion 226 of one of the first pair of differential contacts 22*a* along the longitudinal direction A-A. Similarly, the first soldering portions 216 of the second signal contact 2*d* and the ground contact 2*b* are aligned with the second soldering portion 226 of one of the second pair of differential contacts 22*b* along the longitudinal direction A-A.

Figure 14:
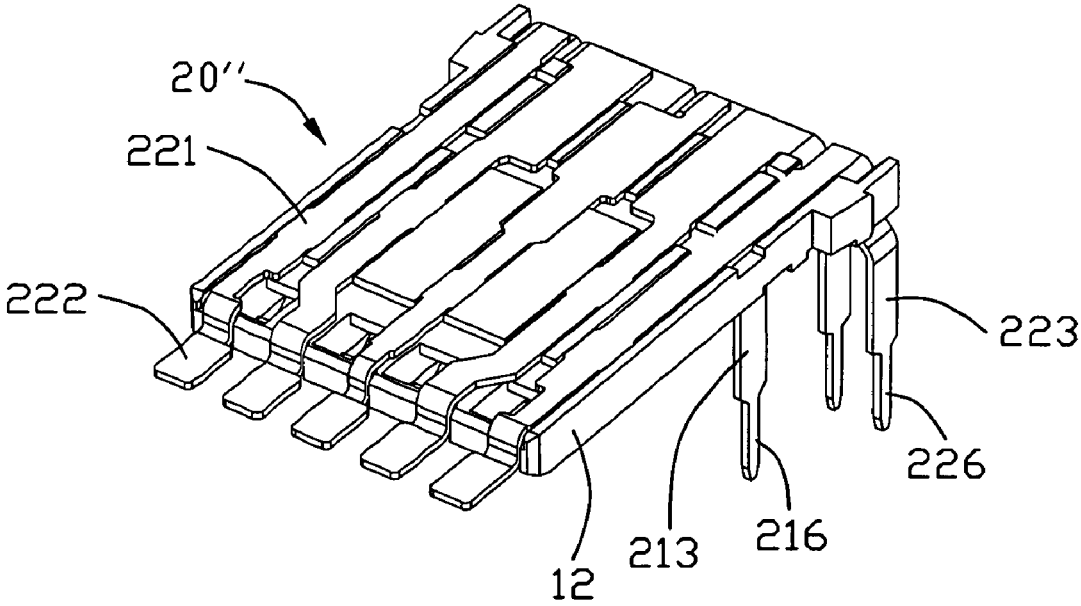
FIG. 14 is a perspective view of another contact module according to a third preferred embodiment of the present invention.
Figure 15:
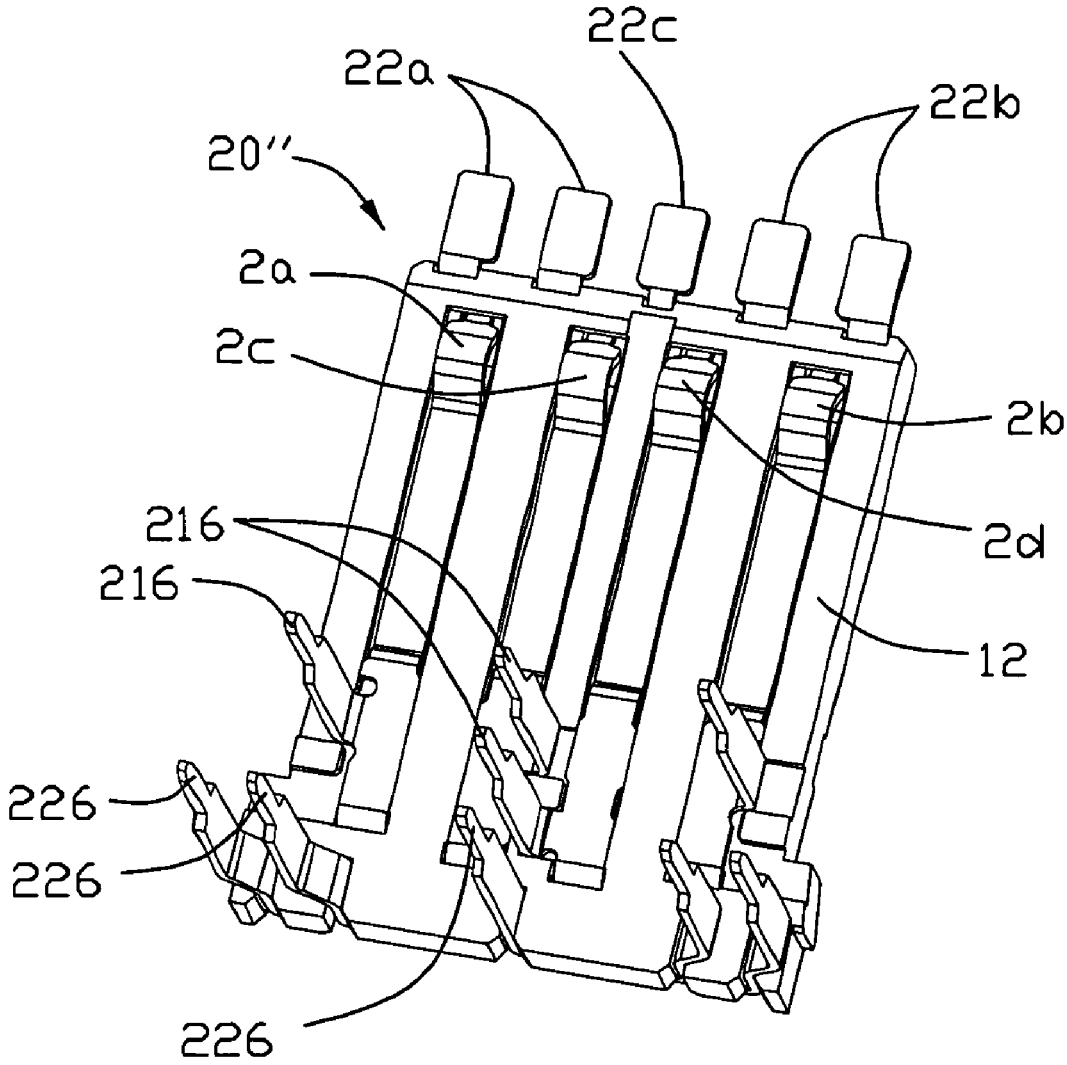
FIG. 15 is another perspective view of FIG. 14, while taken from another aspect.
Figure 16:
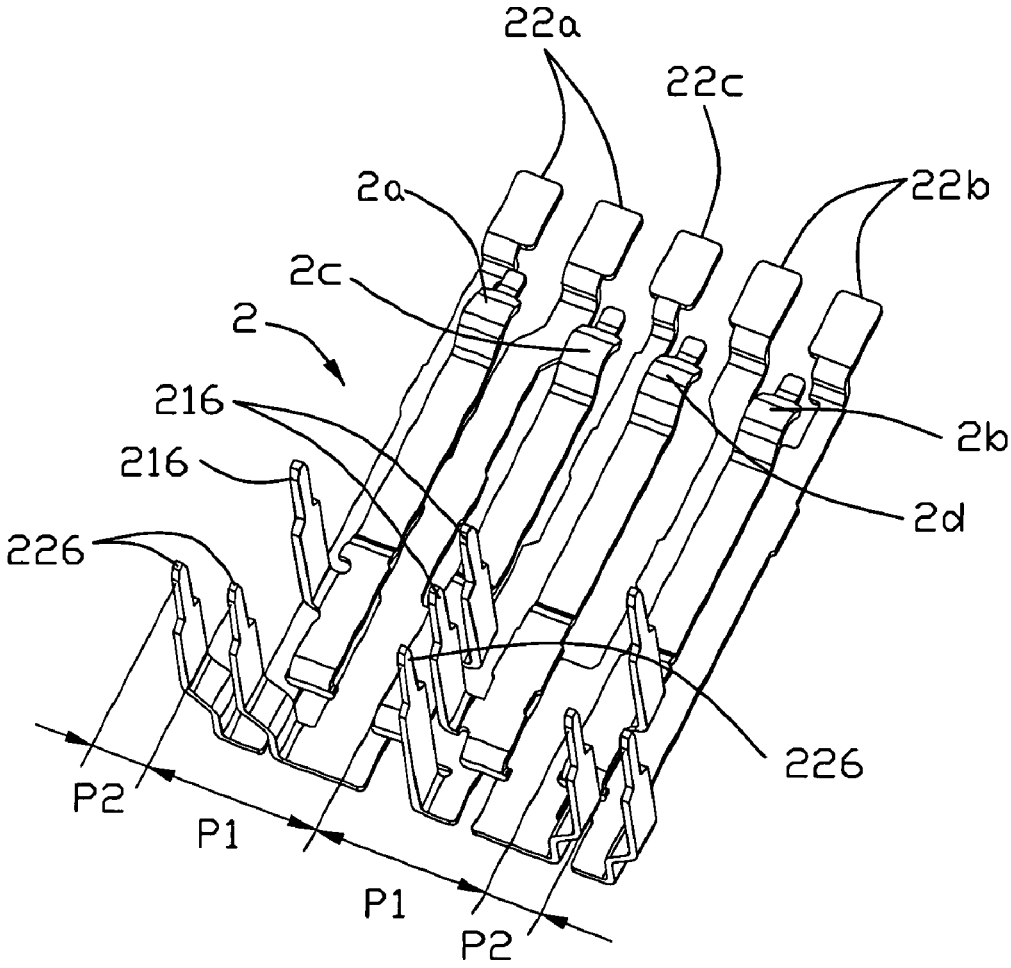
FIG. 16 is a perspective view of the contacts shown in FIG. 15.

Referring to FIGS. 14 to 16, according to a third embodiment of the present invention, the contact module 20" is similar to the contact module 20' of the second embodiment. The differences between them are the contact footprints as well. In detail, at the mounting end, all the first soldering portions 216 of the first contacts 21 are arranged in two parallel transverse rows, among which the first soldering portions 216 of the power contact 2*a*, the first signal contact 2*c* together with the ground contact 2*b* are arranged in a first row and the first soldering portion 216 of the second signal contact 2*d* is arranged in a second row parallel to the first row. All the second soldering portions 226 of the second contacts 22 are arranged in another single row parallel to the first and the second rows. The first soldering portion 216 of the power contact 2*a* is aligned with the second soldering portion 226 of one of the first pair of differential contacts 22*a* along the longitudinal direction A-A. Similarly, the first soldering portion 216 of the ground contact 2*b* is aligned with the second soldering portion 226 of one of the second pair of differential contacts 22*b* along the longitudinal direction A-A. The first soldering portions 216 of the first and the second signal contacts 2*c*, 2*d* are aligned with the second soldering portion 226 of the grounding contact 22*c* along the longitudinal direction A-A.

The electrical connector 100 is compatible to the existing standard USB 2.0 plug which only has corresponding plug contacts for mating with the first contact portions 212. However, the plug with essentially shape of the standard USB 2.0 plug while with additional contacts for mating with the second contacts 22 and/or the optic lens 8 can also be received in the electrical connector 100 for high signal transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector having a mating end for receiving a complementary connector and a mounting end for being mounted to a circuit board, comprising:

a housing member;

a plurality of contacts attached to the housing member, the contacts comprising a plurality of first contacts having first contact portions and first tail portions, and a plurality of second contacts having second contact portions, second bending portions substantially perpendicular to the second contact portions and second tail portions formed at distal ends of the second bending portions, the first and the second contact portions being disposed at the mating end and the first and the second tail portions being disposed at the mounting end, the first and the second contact portions being located at a same side of the housing member under a condition that the first contact portions are arranged side by side along a transverse direction, and similarly, the second contact portions are arranged side by side along the transverse direction; the second contacts including a first pair of differential contacts, a second pair of differential contacts and a grounding contact disposed therebetween, the first and the second tail portions being arranged in two parallel transverse rows, wherein each of the second bending portions comprises a first width viewed from a left-to-right direction along the transverse direction, and a second width viewed from a rear-to-front direction along a longitudinal direction perpendicular to the transverse direction in condition that the second width is narrower than the first width; and wherein at the mounting end, a space between the grounding contact and the differential contact of each pair most adjacent to the grounding contact is much bigger than any internal space between the differential contacts of each the first or the second pair;

a fiber optical lens is located between the first and second pair of differential contacts;

wherein a tail of the grounding contact is located in a slot between the fiber optical lenses.

2. The electrical connector as claimed in claim 1, wherein the first contacts comprise a power contact, a ground contact, a first signal contact and a second signal contact, under a condition that the first contacts are arranged in an area between the second contact portions and the second tail portions along the longitudinal direction.

3. The electrical connector as claimed in claim 2, wherein the first tail portions of the first contacts are arranged in a single row along the transverse direction under a condition that the first tail portions of the power contact and the first signal contact are respectively aligned with the second tail portions of the first pair of differential contacts along the longitudinal direction, and the first tail portions of the second signal contact and the ground contact are respectively aligned with the second tail portions of the second pair of differential contacts along the longitudinal direction.

4. The electrical connector as claimed in claim 2, wherein the first tail portions of the first contacts are arranged in two parallel transverse rows under a condition that the first tail portions of the power contact and the first signal contact are aligned with the second tail portion of one of the differential contact of the first pair along the longitudinal direction, and the first tail portions of the second signal contact and the ground contact are aligned with the second tail portion of one of the differential contact of the second pair along the longitudinal direction.

5. The electrical connector as claimed in claim 2, wherein the first tail portions of the first contacts are arranged in two parallel transverse rows under a condition that the first tail portion of the power contact is aligned with the second tail portion of one of the differential contact of the first pair along the longitudinal direction, the first tail portion of the ground contact is aligned with the second tail portion of one of the differential contact of the second pair along the longitudinal direction, and the rest first tail portions of the first and the second signal contacts are aligned with the second tail portion of the grounding contact along the longitudinal direction.

6. The electrical connector as claimed in claim 1, wherein the first contact portions are elastic and the second contact portions are stiff, the second contact portions being positioned at the front of the first contact portions along the longitudinal direction.

7. The electrical connector as claimed in claim 1, wherein the first contacts comprise L-shaped first main portions extending from the first contact portions and first bending portions bending from lateral edges of the first main portions, the first main portions being mainly located in a same horizontal plane while the first bending portions being mainly located in different vertical planes.

8. The electrical connector as claimed in claim 7, wherein the first tail portions are formed at distal ends of the corresponding first bending portions, and wherein each first tail portion offsets from the corresponding first contact portion viewed from the longitudinal direction.

9. The electrical connector as claimed in claim 1, further comprising a metal shield enclosing the housing member to form a receiving space to which the first and the second contact portions are exposed, the housing member defining a through hole communicating with the receiving space to receive a fiber optic lens.

10. The electrical connector as claimed in claim 1, wherein the housing member comprises a first insulative housing and a second insulative housing received in the first insulative housing, the first and the second contacts being assembled to the second insulative housing with the second contact portions extending beyond the second insulative housing in order to form a contact module, and wherein the contact module is inserted into the first insulative housing with the second contact portions fixed to the first insulative housing.

11. The electrical connector as claimed in claim 10, wherein the first insulative housing comprises a base portion and a tongue plate extending forwardly from the base portion, the tongue plate defining a receiving opening to receive the second insulative housing and a plurality of separate rectangular slots communicating with the receiving opening to receive the second contact portions.

12. An electrical connector assembly comprising:

a housing member having a first insulative housing and a second insulative housing, the first insulative housing comprising a base portion and a tongue plate extending beyond the base portion along a longitudinal direction, the tongue plate defining a receiving opening to receive the second insulative housing;

a metal shell enclosing the housing member to cooperatively form a receiving space for accommodating a complementary connector;

a plurality of contacts attached to the second insulative housing, the contacts comprising a plurality of first contacts having first contact portions and first tail portions, and a plurality of second contacts having second contact portions and second tail portions, the first and the second contact portions being located at a same side of the housing member under condition that the second contact portions extend beyond the second insulative housing to be mounted on the tongue plate, the second contacts including a first pair of differential contacts, a second pair of differential contacts and a grounding contact disposed therebetween, wherein at a mounting end of the electrical connector, a space between the grounding contact and the differential contact of each pair which is most adjacent to the grounding contact, is much bigger than any internal space between the differential contacts of each the first or the second pair; and a fiber optical lens received in a through hole of the base portion and exposed to the receiving space; wherein the fiber optical lens is located between the first and the second pairs of differential contacts when viewed along the longitudinal direction;

wherein a tail of the grounding contact located in a slot between the fiber optical lenses.

13. The electrical connector assembly as claimed in claim 12, wherein the first contacts comprise a power contact, a ground contact, a first signal contact and a second signal contact, under a condition that the first contacts are arranged in an area between the second contact portions and the second tail portions along the longitudinal direction.

14. The electrical connector as claimed in claim 13, wherein the first tail portions of the first contacts are arranged in a single row along the transverse direction under a condition that the first tail portions of the power contact and the first signal contact are respectively aligned with the second tail portions of the first pair of differential contacts along the longitudinal direction, and the first tail portions of the second signal contact and the ground contact are respectively aligned with the second tail portions of the second pair of differential contacts along the longitudinal direction.

15. The electrical connector as claimed in claim 13, wherein the first tail portions of the first contacts are arranged in two parallel transverse rows under a condition that the first tail portions of the power contact and the first signal contact are aligned with the second tail portion of one of the differential contact of the first pair along the longitudinal direction, and the first tail portions of the second signal contact and the ground contact are aligned with the second tail portion of one of the differential contact of the second pair along the longitudinal direction.

16. The electrical connector as claimed in claim 13, wherein the first tail portions of the first contacts are arranged in two parallel transverse rows under a condition that the first tail portion of the power contact is aligned with the second tail portion of one of the differential contact of the first pair along the longitudinal direction, the first tail portion of the ground contact is aligned with the second tail portion of one of the differential contact of the second pair along the longitudinal direction, and the rest first tail portions of the first and the second signal contacts are aligned with the second tail portion of the grounding contact along the longitudinal direction.

17. An electrical connector comprising:

a first insulative housing defining a first forwardly extending tongue plate with opposite first and second surfaces in a vertical direction;

a second insulative housing defining a second forwardly extending tongue plate with opposite first and second faces in said vertical direction;

a first set of deflectable contacts disposed on the first face of the second housing and defining first contacting sections thereof;

a second set of stiff contacts disposed on the second face of the second housing and defining thereof second contacting sections which is located in front of the first contacting sections and being offset from the second face and being adjacent to the first face;

the second housing with the associated deflectable contacts and stiff contacts, engaged with the first housing under condition that the second face of the second housing intimate confronts the first surface of the first housing; wherein the stiff contacts are sandwiched between the second face of the second housing and the first surface of the first housing except said second contacting sections which cooperate with the first contacting sections to be exposed to an exterior for mating;

wherein the second set stiff contacts including a first pair of differential contacts, a second pair of differential contacts, and a grounding contact disposed there between;

wherein a fiber optical lenses is located between the first and second pair of differential contacts;

wherein a tail of the grounding contact is located in a slot between the fiber optical lenses.

18. The electrical connector as claimed in claim 17, wherein both said deflectable contacts and the stiff contacts include downwardly extending mounting tails, and the second housing defines a plurality of slits extending through both the first face and the second face to retain mounting tails of one set of said first set of deflectable contacts and the second set of the stiff contacts, which is closer to a printed circuit board, on which the connector is mounted, than the other.

19. The electrical connector as claimed in claim 17, wherein the first housing includes a plurality of slots each receiving the mounting tails of both the deflectable contacts and the stiff contacts under condition that said mounting tails are aligned with each other in a front-to-back direction.

20. The electrical connector as claimed in claim 17, wherein said second contacting sections are fully exposed in front of the second housing while disposed in corresponding recess formed in the first housing.

* * * * *